US007604510B2

(12) United States Patent
Akama et al.

(10) Patent No.: US 7,604,510 B2
(45) Date of Patent: Oct. 20, 2009

(54) HIGH SPEED TRANSMISSION CONNECTOR

(75) Inventors: Junichi Akama, Shinagawa (JP); Tadashi Kumamoto, Shinagawa (JP); Takahiro Kondo, Shinagawa (JP); Yoko Tanaka, Shinagawa (JP); Mitsuru Kobayashi, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/703,232

(22) Filed: Feb. 7, 2007

(65) Prior Publication Data

US 2007/0184718 A1 Aug. 9, 2007

(30) Foreign Application Priority Data

Feb. 7, 2006 (JP) ..... 2006-029584

(51) Int. Cl.
*H01R 24/00* (2006.01)

(52) U.S. Cl. ..... 439/637; 439/678

(58) Field of Classification Search ..... 439/637, 439/857, 733.1, 678, 60, 608, 108; 608/607.03
See application file for complete search history.

(56) References Cited

U.S. PATENT DOCUMENTS 6,464,521 B1 * 10/2002 Kurotori et al. ..... 439/260
6,805,586 B2 * 10/2004 Akama et al. ..... 439/608
6,923,664 B2 * 8/2005 Ito et al. ..... 439/108
7,198,519 B2 * 4/2007 Regnier et al. ..... 439/637
2004/0242071 A1 * 12/2004 Ito et al. ..... 439/608

FOREIGN PATENT DOCUMENTS

JP 3685908 6/2005

* cited by examiner

*Primary Examiner*—Edwin A. Leon
*Assistant Examiner*—Vanessa Girardi
(74) *Attorney, Agent, or Firm*—Staas & Halsey LLP

(57) ABSTRACT

A high speed transmission connector including several signal contact pairs arranged in a parallel array, each including a pair of signal contacts constituting a balanced transmission line; several ground contacts, each being arranged between two signal contact pairs arranged in the parallel array; and an electro-insulating body supporting the signal contact pairs and the ground contacts. Each signal contact is provided with a contacting section at one longitudinal end for conductive contact with a corresponding signal contact of a counterpart connector, a board connecting section at another longitudinal end for connection with a conductor on a circuit board, and an attaching section between the contacting section and the board connecting section for an attachment to the body. All of the board connecting sections of the signal contacts are disposed along a first lateral surface of the body. The signal contacts of the signal contact pairs are individually covered, at least partially, by materials having dielectric constants different from each other, in certain regions defined between board connecting sections and attaching sections.

5 Claims, 6 Drawing Sheets

HIGH SPEED TRANSMISSION CONNECTOR

BACKGROUND OF THE INVENTION

1. Field of the Invention

The present invention relates to a high speed transmission connector.

2. Description of the Related Art

A high speed transmission connector, including a plurality of signal contact pairs which are arranged in a parallel array and each of which includes a pair of signal contacts constituting a balanced transmission line, a plurality of ground contacts which are arranged alternately relative to the signal contact pairs and each of which is arranged between two of signal contact pairs arranged in the parallel array, and an electro-insulating body which supports the signal contact pairs and the ground contacts in a mutually insulated arrangement, is conventionally known (see, e.g., Japanese Patent No. 3685908). In this configuration, a signal contact pair constituting a balanced transmission line which is unlikely to be affected by noise is used, and in addition, cross talk between adjacent signal contact pairs is suppressed by arranging a ground contact between the two signal contact pairs arranged side-by-side, so that signal transmission characteristics of the connector can be significantly improved.

In a case where the above high speed transmission connector is configured for circuit-board mount use, each signal contact is provided with a contacting section at one longitudinal end for coming into conductive contact with a corresponding signal contact of a counterpart connector, and a board connecting section at the other longitudinal end for connection to a conductor on the circuit board. In view of reducing the difference in signal transmission time in a balanced transmission (also called differential transmission) as much as possible, it is advantageous that a pair of signal contacts constituting each signal contact pair have shapes and dimensions identical to each other.

In a conventional high speed transmission connector for a circuit board as described above, in the case where the pair of signal contacts constituting each signal contact pair have mutually identical shapes and dimensions, the board connecting sections of individual signal contacts are disposed respectively along a pair of lateral surfaces of a connector body, extending in a longitudinal direction (in the direction of a contact array). Thus, when the high speed transmission connector is to be connected, on the circuit board, to another electronic component disposed, for example, in close proximity to one of the lateral surfaces of the body, a conductor pattern connecting the two may become complicated depending on the relative position between the connector and the electronic part. In particular, since it is required also for conductors formed by patterning on the circuit board that difference in the signal transmission time in balanced transmission be reduced as much as possible, it is desirable that a pair of conductors connected to a signal contact pair have the same length. As a result, this may further complicate the conductor pattern.

On the other hand, another configuration is known in which, by forming the neighborhood region of respective board connecting sections of a pair of signal contacts constituting the signal contact pairs in shapes different from each other, board connecting sections of all the signal contact pairs are disposed along only one lateral surface of the connector body. With this configuration, when the high speed transmission connector is to be connected to another electronic part disposed in close proximity to one lateral surface of the connector body on the circuit board, the conductor pattern connecting the two can be simplified.

However, with this configuration, in each signal contact pair, one of the signal contacts has shorter spatial distance between the contacting section and the board connecting section than that of the other signal contact, and this may leads to a problem of difference in signal transmission time in balanced transmission. In order to avoid this problem, in a generally adopted approach, the neighborhood region of the board connecting section of the signal contact having the smaller distance between the contacting section and the board connecting section is formed in a curved shape locally bent toward the other signal contact such that there is no difference in total length between the two contacts. However, this may lead to another problem that, in such a contact having curved portion with small radius of curvature, the signal transmission characteristics may deteriorate due to a magnetic field disturbance that may arise from the curved portion.

SUMMARY OF THE INVENTION

It is an object of the present invention to provide a high speed transmission connector including a plurality of signal contact pairs respectively constituting balanced transmission lines, wherein a difference in signal transmission time can be reduced as much as possible, wherein a conductor pattern on a circuit board can be simplified when the connector is mounted on the circuit board, and wherein a signal contact unlikely to produce a disturbance in a magnetic field is used.

To accomplish the above object, the present invention provides a high speed transmission connector comprising a plurality of signal contact pairs, the signal contact pairs being arranged in a parallel array, and each of the signal contact pairs including a pair of signal contacts comprising a balanced transmission line; a plurality of ground contacts, each of the ground contacts being arranged between two of the signal contact pairs arranged in the parallel array, the plurality of signal contact pairs and the plurality of ground contacts being alternately arranged relative to each other; and an electro-insulating body supporting the plurality of signal contact pairs and the plurality of ground contacts in a mutually insulated arrangement; wherein each of the signal contacts of the plurality of signal contact pairs is provided with a contacting section at one longitudinal end for a conductive contact with a corresponding signal contact of a counterpart connector, a board connecting section at another longitudinal end for a connection with a conductor on a circuit board, and an attaching section between the contacting section and the board connecting section for an attachment to the body; wherein all of the board connecting sections of the signal contacts of the plurality of signal contact pairs are disposed along a first lateral surface of the body; and wherein the pair of signal contacts of the plurality of signal contact pairs are individually covered, at least partially, by materials having dielectric constants different from each other, in certain regions, each region being defined between the board connecting section and the attaching section of each signal contact.

In accordance with the above invention, since the board connecting sections of all the signal contacts are disposed along the first lateral surface of the body, when the high speed transmission connector is to be connected to another electronic part disposed in close proximity of the lateral surface of the body on the circuit board, for example, the conductor pattern connecting the two can be simplified. In addition, since the region between the board connecting section and the attaching section can be formed in a non-roundabout shape, the problem encountered in prior art, in that the signal transmission characteristics may deteriorate due to a magnetic field disturbance arising from the curved portion with small radius of curvature, can be reliably avoided. Further, in spite of the difference in the length of the relevant regions of a pair of signal contacts from each other, the difference in transmission time of the signal contact pair can be minimized as much as possible by covering the shorter region with a material of higher dielectric constant (specific inductivity) and the longer region with a material of lower dielectric constant (specific inductivity).

In the above-described high speed transmission connector, a material covering at least one of the regions of the pair of signal contacts may be a part of the body. In this arrangement, the material for covering at least one region of a pair of signal contacts can be prepared easily.

Alternatively, a material covering one of the regions of the pair of signal contacts may be air. In this arrangement, the material for covering one region of a pair of signal contacts can be easily provided.

The region of one of the pair of signal contacts, covered by a first material having a higher dielectric constant, may be smaller in cross-sectional area than a region of another signal contact covered by a second material having a lower dielectric constant. In this arrangement, characteristic impedance of the high speed transmission connector can be adjusted by suitably selecting the cross-sectional area of the signal contact.

Each of the plurality of ground contacts may be provided with a pair of contacting sections at one longitudinal end for a conductive contact with a corresponding ground contact of a counterpart connector, a pair of board connecting sections at another longitudinal end for a connection with a grounding potential on a circuit board, and an attaching section between the contacting sections and the board connecting sections for an attachment to the body; and all of the board connecting sections of the ground contacts may be disposed respectively along the first lateral surface and a second lateral surface of the body, opposite to the first lateral surface; and wherein each of the plurality of ground contacts is shaped in such a manner as to conceal the pair of signal contacts of each of the plurality of signal contact pairs as seen in a direction of the parallel array, when the plurality of signal contact pairs and the plurality of ground contacts are disposed at proper positions on the body. In accordance with this structure, cross talk between parallel signal contact pairs can be significantly reduced.

BRIEF DESCRIPTION OF THE DRAWINGS

The above and other objects, features and advantages of the present invention will become more apparent from the following description of preferred embodiments in connection with the accompanying drawings, wherein.

DESCRIPTION OF THE PREFERRED EMBODIMENT

Figure 1:
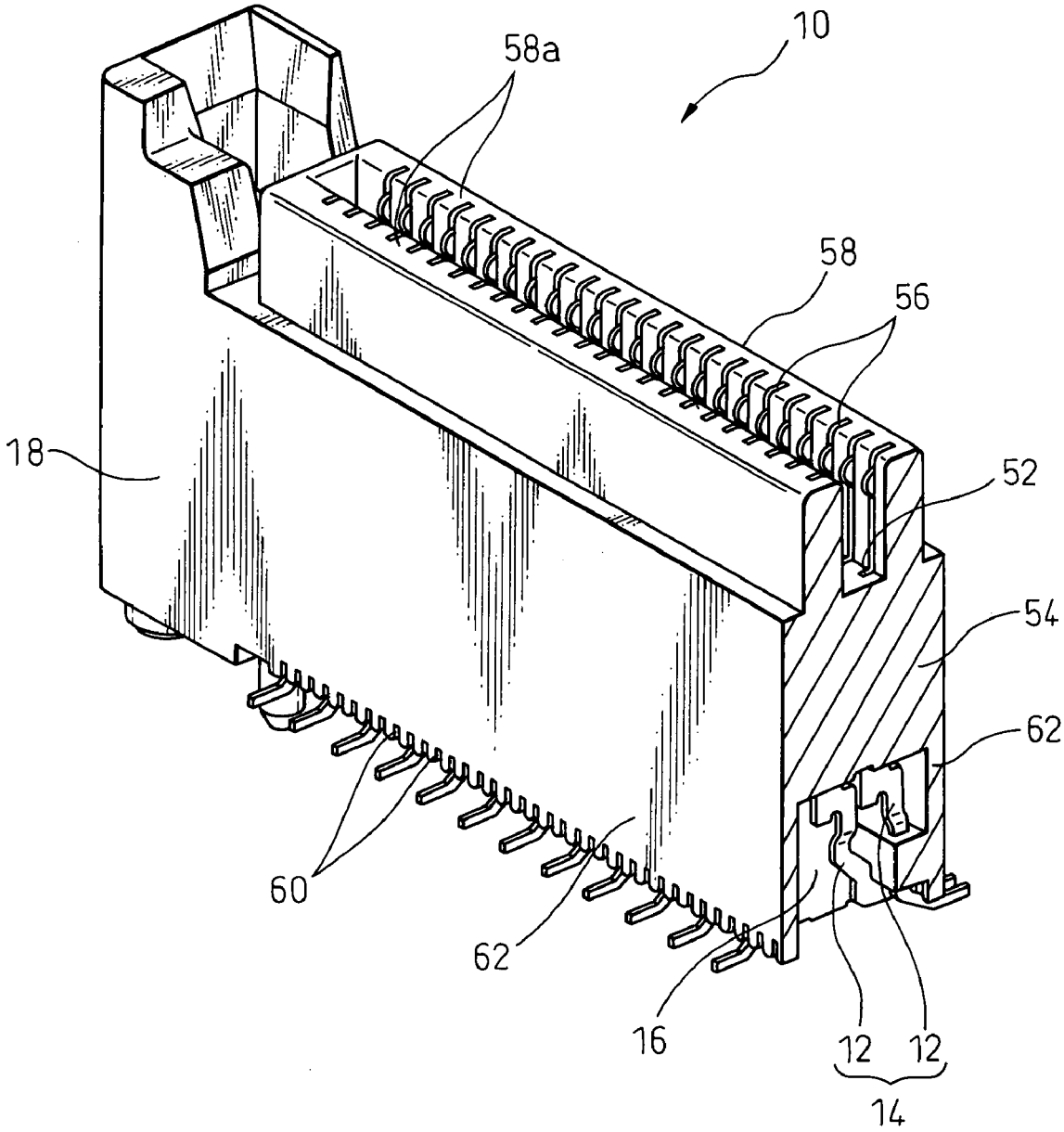
FIG. 1 is a partially cut-out perspective view showing a high speed transmission connector according to an embodiment of the present invention.

The embodiments of the present invention are described below in detail, with reference to the accompanying drawings. In the drawings, the same or similar components are denoted by common reference numerals.

Figure 2:
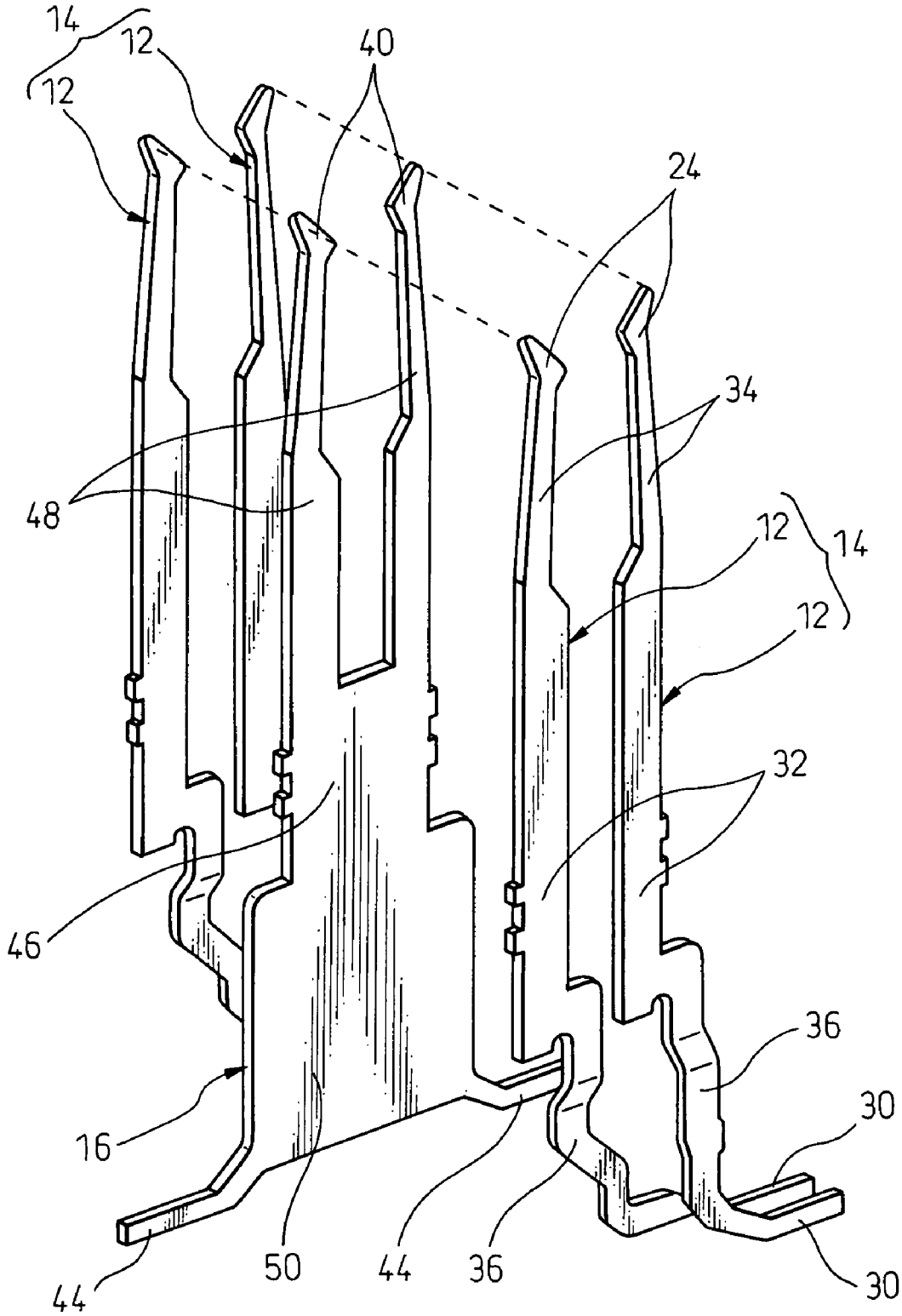
FIG. 2 is an enlarged perspective view showing a contact of the high speed transmission connector of FIG. 1.
Figure 3:
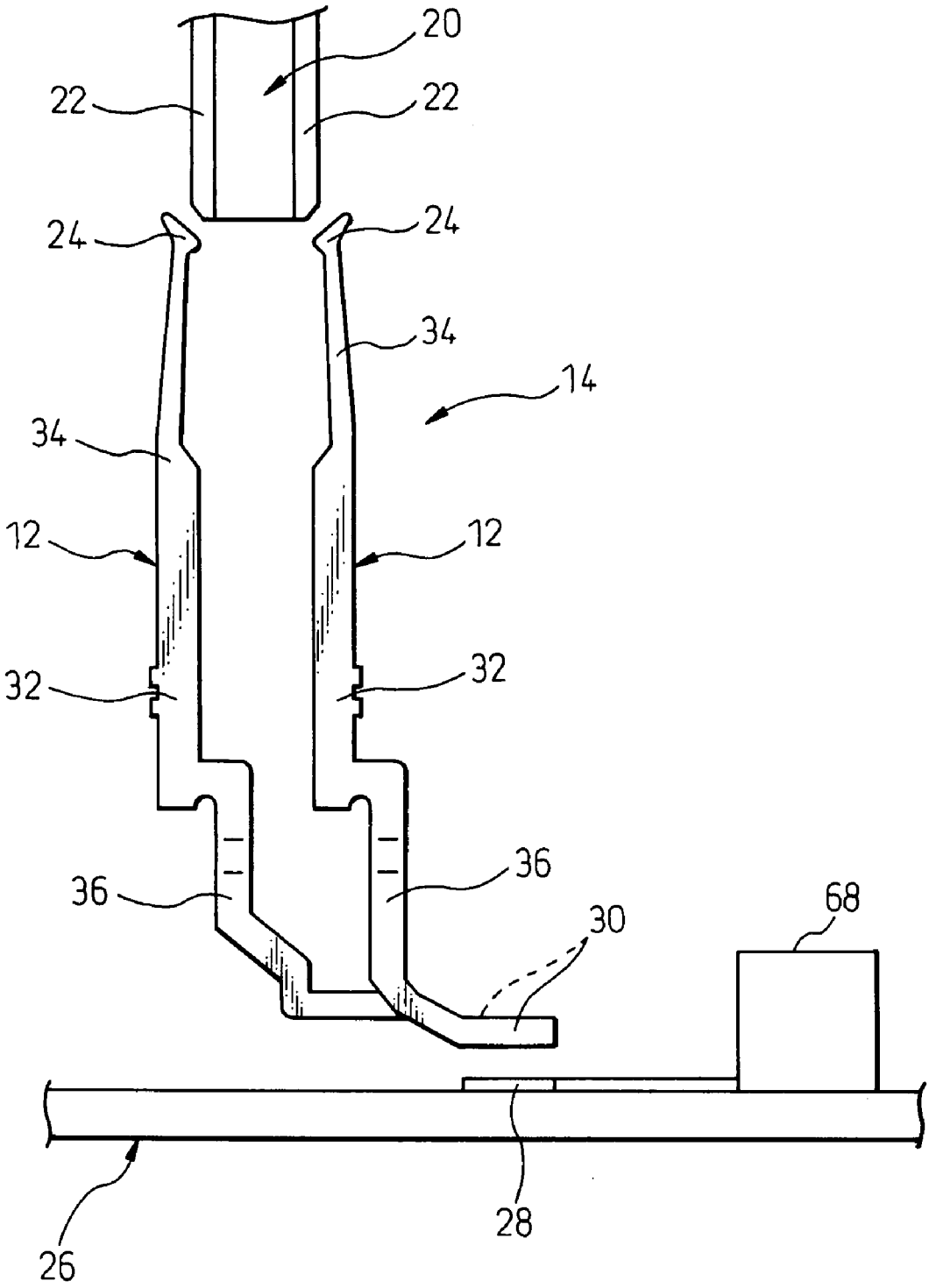
FIG. 3 is a view showing schematically the connecting configuration of the signal contact pair of the high speed transmission connector of FIG. 1 with another conductor.
Figure 4:
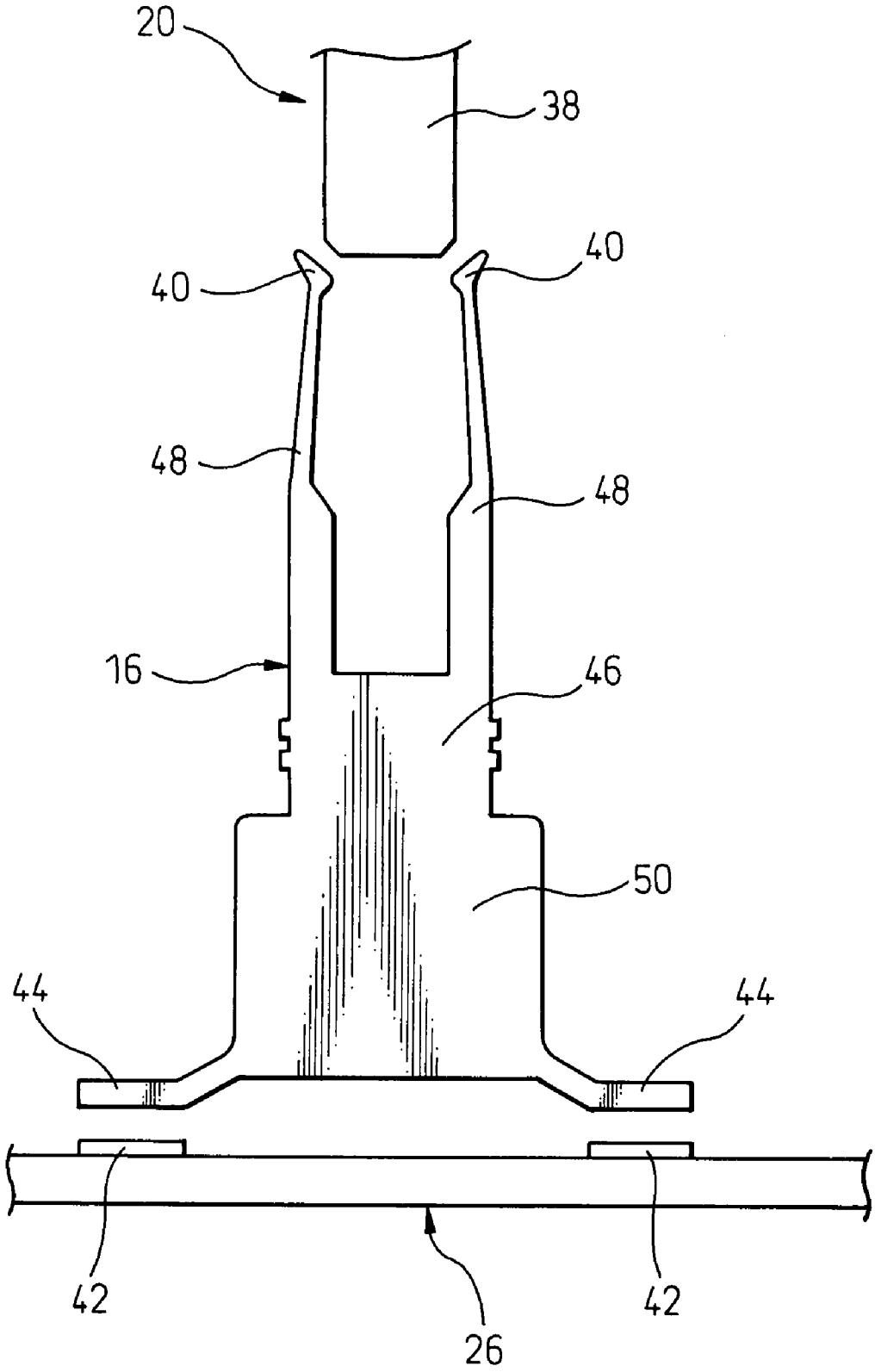
FIG. 4 is a view showing schematically the connecting configuration of the ground contact of the high speed transmission connector of FIG. 1 with another conductor.
Figure 5:
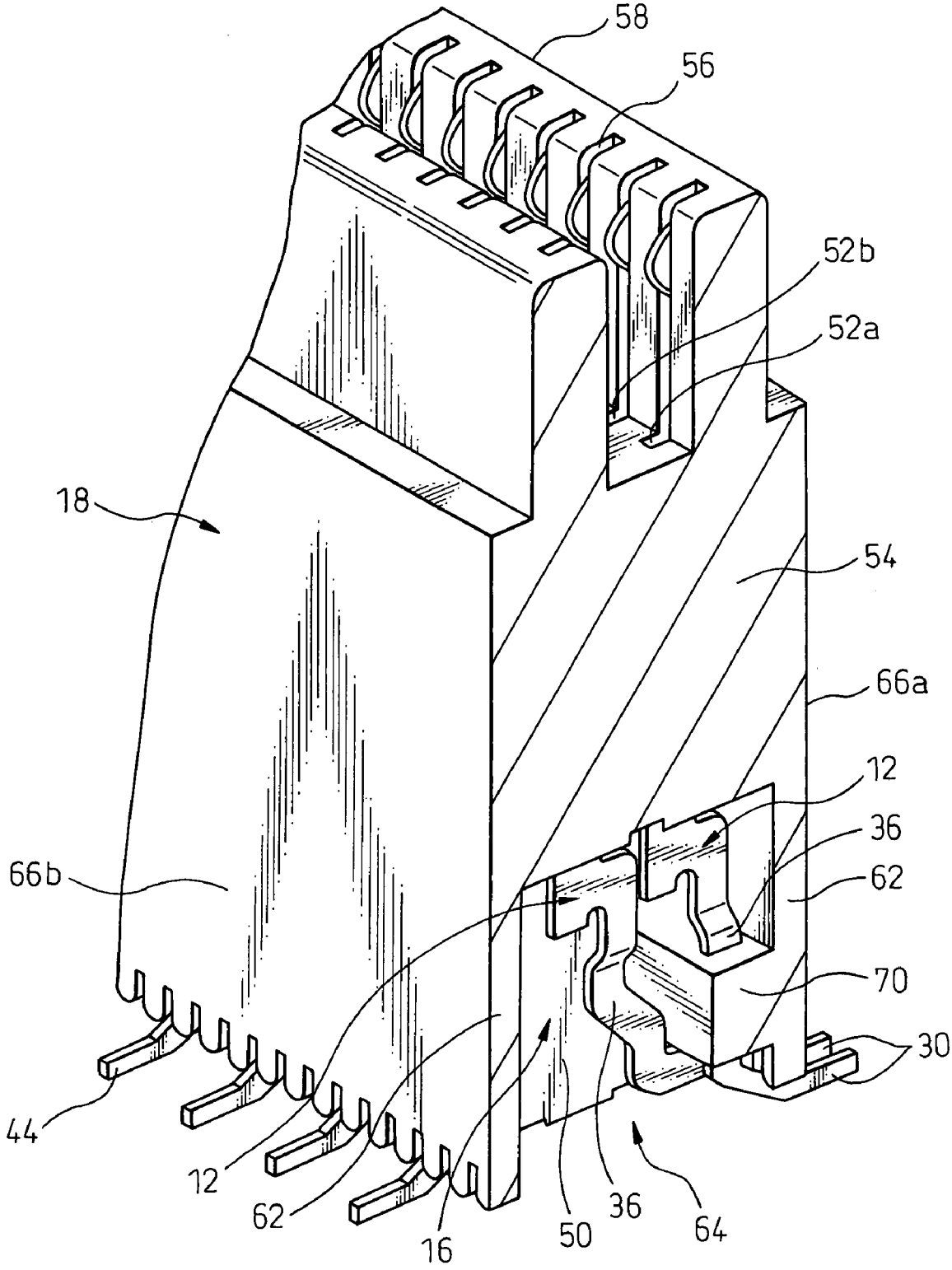
FIG. 5 is an enlarged perspective view showing main characteristic portion of the high speed transmission connector of FIG. 1.
Figure 6:
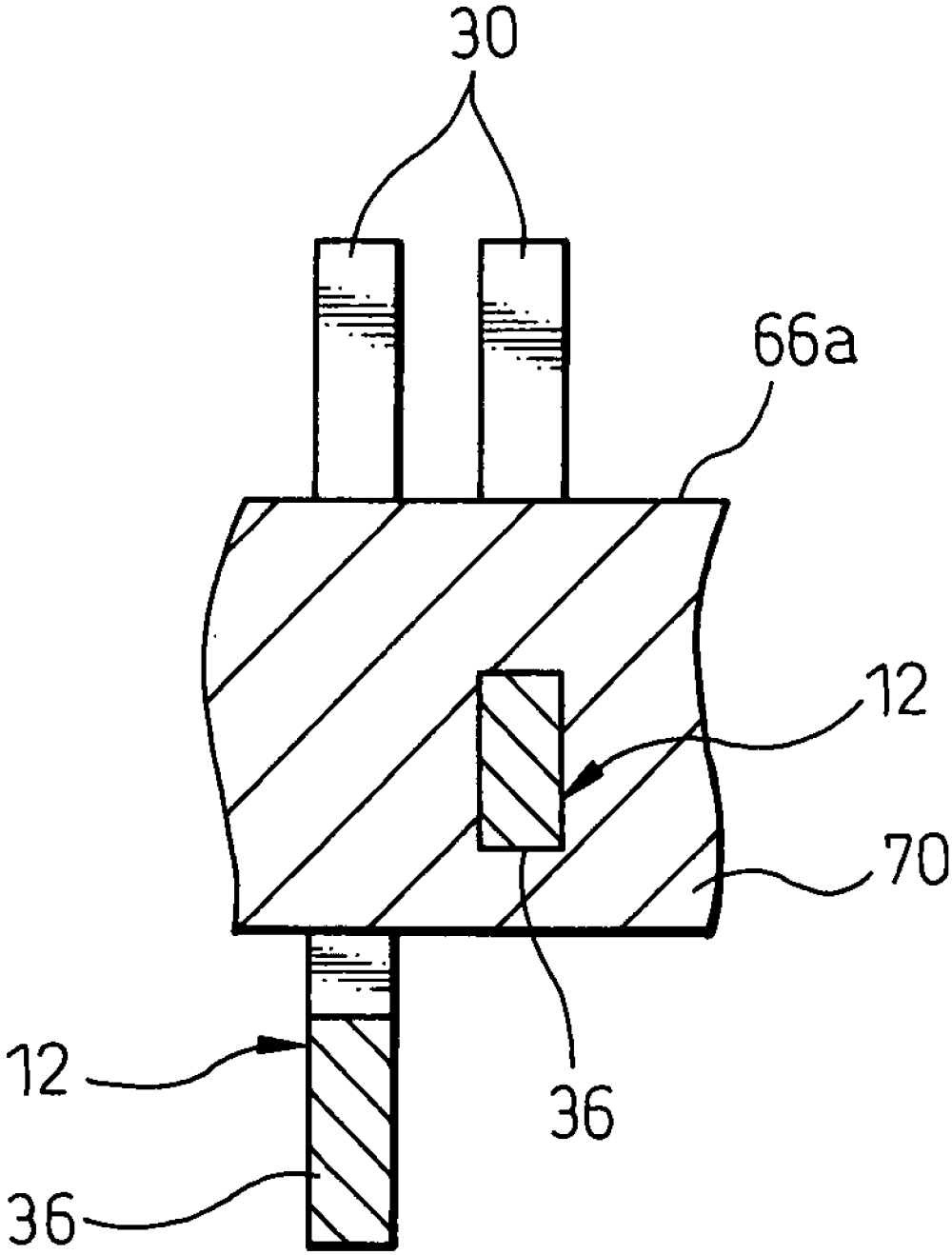
FIG. 6 is an enlarged sectional view showing main characteristic portion of the high speed transmission connector of FIG. 1.

Referring to the drawings, FIG. 1 is a perspective view showing a high speed transmission connector 10 according to an embodiment of the present invention, FIG. 2 is a perspective view showing a contact of the high speed transmission connector 10, FIGS. 3 and 4 are views schematically showing the connecting configuration of individual contacts and another conductor, FIG. 5 is an enlarged perspective view showing a main characteristic portion of the high speed transmission connector 10, and FIG. 6 is an enlarged sectional view showing the same characteristic portion. The high speed transmission connector 10 is used as a balanced transmission (or a differential transmission) connector, for example, in a computer, server, exchanger, router, etc.

As shown in FIG. 1, the high speed transmission connector 10 includes a plurality of signal contact pairs 14, the signal contact pairs being arranged in a parallel array, and each of the signal contact pairs including a pair of signal contacts 12 comprising a balanced transmission line; a plurality of ground contacts 16, each of the ground contacts being arranged between two of the signal contact pairs 14 arranged in the parallel array, the signal contact pairs 14 and the ground contacts 16 being alternately arranged relative to each other; and an electro-insulating body 18 supporting the signal contact pairs 14 and the ground contacts 16 in a mutually insulated arrangement. The high speed transmission connector 10 has the configuration adapted to be mounted on a circuit board, and is combined with another connector (herein referred to as counterpart connector) similarly comprising a plurality of signal contact pairs and a plurality of ground contacts to form a connectable/disconnectable connector structure.

The signal contact 12 and ground contact 16 are both prepared by punching a sheet metal material of good electrical conductivity into desired shapes. The body 18 is formed from desired resin material having excellent insulating property, mechanical strength, and heat resistance, etc., by injection molding, for example.

As shown in FIGS. 2 and 3, each of the signal contacts 12 of a plurality of signal contact pairs 14 is provided with a contacting section 24 at one longitudinal end for conductive contact with a corresponding signal contact 22 of a counterpart connector, a board connecting section 30 at the other longitudinal end to be connected to a conductor 28 on a circuit board 26, and an attaching section 32 defined between the contacting section 24 and the board connecting section 30 to be attached to the body 18. A pair of signal contacts 12 of each signal contact pair 14 have respective contact sections 24 and attaching sections 32 of a shape identical to each other, while the board connecting sections 30 have shapes extending laterally relative to respective board connecting sections 32 and oppositely relative to respective contacting section 24 for lengths different from each other.

The contact section 24 of each signal contact 12 is formed at an end of an arm 34 extending generally straight from the attaching section 32, and is adapted to be displaced slightly with respect to the attaching section 32 by elastic deformation of the arm 34. A pair of the signal contacts 12 of each signal contact pair 14 has the regions 36 between respective board connecting sections 30 and the attaching sections 30 formed in a shape bent in the same direction of the plate thickness as seen from the attaching sections 32. Thus, when a pair of the signal contacts 12 are disposed such that respective contact sections 24 and attaching sections 32 are aligned and opposed to make a mirror image to each other, the board connecting sections 30 of the signal contacts 12 are positioned separated in the direction of plate thickness in parallel and not in contact with each other.

As shown in FIGS. 2 and 4, each of a plurality of the ground contacts 16 comprises a pair of contacting sections 40 at one longitudinal end for conductive contact with corresponding contact 38 of a counterpart connector 20, a pair of board connecting sections 44 at the other longitudinal end to be connected to the grounding potential 42 on the circuit board 26, and attaching section 46 attached to the body 18 between the contacting sections 40 and the board connecting sections 44. A pair of the contact sections 40 is formed at the end of a pair of arms 48 extending generally straight from the attaching section 46 and is adapted to be displaced slightly with respect to the attaching section 46 by elastic deformation of the arm 48. A pair of the board connecting sections 44 is extended on each side of the attaching section 46 in the direction opposite to each other for same length. The region 50 between the board connecting section 44 and the attaching section 46 has a shape of rectangular plate of relatively large area. As shown in the drawings, the ground contact 16 has a line-symmetric shape.

As shown in FIG. 1, the body 18 includes, as one integral unit, a main portion 54 having a plurality of through-holes 52 for individually receiving the attaching sections 32 of a plurality of the signal contact 12 and attaching sections 46 of a plurality of the ground contacts 16 in press-fit manner, a fitting portion 58 having a plurality of grooves 56 for individually receiving the contacting sections 24 of a plurality of the signal contacts 12 and the contacting sections 40 of a plurality of the ground contacts 16 in elastically deformable manner, and a pair of lateral wall portion 62 having a plurality of grooves 60 for individually receiving and supporting the board connecting sections 30 of a plurality of the signal contacts 12 and the board connecting sections 44 of a plurality of the ground contacts 16. FIG. 1 is a view showing the body 18 as broken in the mid-point in longitudinal direction, and not-shown remaining part has a mirror image configuration of the shown part.

The main portion 54 of the body 18 is a bar-shaped element with a rectangular cross section extending in the direction of alignment of the signal contact 12 and the ground contact 16. The fitting portion 58 of the body 18 comprises a pair of walls 58*a* projecting transversally from the main portion 54 and extending in the longitudinal direction of the main portion 54 in parallel to each other. The walls 58*a* fit detachably to a not-shown insulating body of the counterpart connector 20 (FIG. 3). A plurality of grooves 56 are formed in the mutually opposed plane of both walls 58*a* of the fitting portion 58 transversally to the walls 58*a* so as to face each other and at equal intervals in the longitudinal direction. A plurality of through-holes 52 of the main portion 54 are formed individually in straight communication with the grooves 56 at equal intervals in the longitudinal direction of the main portion 54. The through-holes 52 are composed by alternately arranging, in longitudinal direction of the main portion 54, a pair of through-holes 52*a* aligned in transversal direction similarly to a pair of the grooves 56 facing each other in transversal direction and a through-hole 52*b* extending in transversal direction so as to link the grooves 56 of same pair to each other (FIG. 5).

A pair of the lateral walls 62 of the body 18 is provided so as to project transversally from the main portion 54 on the side opposite to the fitting portion 58, and extends in parallel to each other in the longitudinal; direction of the main portion 54. The lateral wall portions 62 define, in cooperation with the main portion 54, a space 64 for accommodating the regions 46, 50 between the board connecting sections 30, 44 and the attaching sections 32, 46 of a plurality of the signal contacts 12 and a plurality of ground contacts 16, respectively (FIG. 5). The outer surface of each lateral wall portion 62 is disposed flush with the outer surface of the main portion 54 so as to define a pair of sides 66*a*, 66*b* of the body 18 (FIG. 5).

As described above, a pair of signal contacts 12 of each signal contact pair 14 are received by a pair of through-holes 52 and a pair of grooves 56*a* aligned in transverse direction of the body 18 with respective contacting sections 24 and attaching sections 32 opposed and aligned so as to form a mirror image to each other. Each ground contact 16 with a pair of contacting sections 40 and attaching section 50 is received by a pair of through-holes 52 and a groove 56*b* of the body 18.

In this manner, when a plurality of the signal contact pairs 14 and a plurality of the ground contacts 16 are arranged in a predetermined proper position on the main body 18, all the board connecting sections 30 of plural pairs of the signal contacts 12 of the signal contact pairs 14 are disposed in parallel to each other along the first lateral surface 66*a* of the body 18. Here, the board connecting sections 30 of all the signal contacts 12 extend to a position at equal distance from the first lateral surface 66*a* of the body 18. All the board connecting sections 44 of a plurality of the ground contacts 16 are arranged in parallel to each other along the first lateral surface 66*a* of the body 18 and the second lateral surface 66*b* on the opposite side, respectively. The board connecting sections 30 of the plural pairs of signal contacts 12 and the board connecting sections 44 of a plurality of ground contacts 16 arranged along the first lateral surface 66*a* of the body 18 are maintained at equal intervals as seen in the longitudinal direction of the body.

When the signal contact pairs 14 and the ground contacts 16 are disposed in proper position on the body 18, each ground contact 16 has a shape such that it masks a pair of the signal contacts 12 of each signal contact pair 14 as seen in the longitudinal direction of the body (i.e., in the direction of the parallel contact array). In the embodiment shown, the outline of the ground contact 16 partially coincides with the outline of a pair of signal contacts 12 disposed in opposition, and in particular, the outline of the contacting section 40, arm 48 and board connecting section 44 of the former coincides with the outline of the contacting section 24, arm 34 and board connecting section 30 of the latter. With such a configuration, cross talk between adjacent parallel signal contact pairs 14 can be reduced as much as possible with minimum material cost.

A pair of signal contacts 12 of each signal contact pair 14 are individually covered at least partially in the regions 36 between respective board connecting section 30 and the attaching section 32 with materials of dielectric constant different from each other. More specifically, of the signal contacts 12 constituting a pair, a first signal contact 12 disposed in close proximity to the first lateral surface 66*a* of the body 18 has the region 36 between the board connecting section 30 and the attaching section 32 of shorter length than that of a second signal contact 12 disposed in close proximity to the second lateral surface 66*b* of the body 18, and therefore has faster signal transmission speed. Accordingly, by covering the region 36 of the first signal contact 12 with a material of higher dielectric constant (or specific inductivity) and covering the region 36 of the second signal contact 12, on the other hand, with a material of lower dielectric constant (or specific inductivity), signal transmission speed in the region 36 of the first signal contact 12 can be lowered so as to reduce the difference in transmission time in the signal contact pair 14 as much as possible.

Thus, since the high speed transmission connector 10 is constructed such that respective regions 36 of a pair of signal contacts 12 of each signal contact pair 14 are individually covered by materials having dielectric constants different from each other, a difference in signal transmission time in the signal contact pair 14 can be reduced as much as possible in spite of the difference in the length of the regions 36 of the signal contacts 12. In addition, since the region 36 can be formed in a shape not having a roundabout between the board connecting section and the attaching section, the problem in prior art, wherein signal transmission characteristics may deteriorate due to a magnetic field disturbance arising from the curved portion with small radius of curvature, can be reliably avoided. Since, in the high speed transmission connector 10 having above-described configuration, the board connecting sections 30 of all the signal contacts 12 are disposed along one lateral surface 66*a* of the body 18, even when the connector is connected to another electronic part 68 disposed in close proximity to the body lateral surface 66*a* on the circuit board 26 (FIG. 3), for example, the pattern of conductor connecting the two can be simplified.

In the embodiment shown, the material covering the region 36 of the first signal contact 12 disposed in close proximity to the first lateral surface 66*a* of the body 18 is a portion of the body 18, and is composed of a rib 70 of generally rectangular cross section that is provided integrally from one lateral wall portion 62 into the void 64 and extending in the longitudinal direction of the body (FIG. 5). On the other hand, the material covering the region 36 of the second signal contact 12 disposed in close proximity of the second lateral surface 66*b* of the body 18 is air in the void 64. With such a configuration, materials covering the regions of the first and the second signal contacts 12 can be prepared or provided very easily. The connector can be constructed such that the both regions 36 of the first and the second signal contacts 12 are totally or partly covered with resin materials integral with or separate from the body 12 having dielectric constant (or specific inductivity) different from each other.

In the high speed transmission connector 10 having above configuration, since respective regions 36 of a pair of signal contacts are covered with materials of different dielectric constants, the characteristic impedance having been set with region 36 of the two signal contacts 12 exposed, for example, to air, may be altered by the presence of the dielectric materials. Therefore, by forming the region 36 of one signal contact 12 covered with a first material of higher dielectric constant (or a rib 70, in the drawing) such that it has a smaller cross-sectional area than the region 36 of the other signal contact 12 covered with a second material of lower dielectric constant (or air, in the drawing) than the first material, the characteristic impedance of the high speed transmission connector can be adjusted to the state as originally set.

Although the present invention has been described above with reference to preferred embodiments, the present invention can be implemented with various modifications and variations. For example, in place of the configuration shown in which a portion of the region 36 of the signal contact 12 is covered with a material of high dielectric constant (or the rib 70), one can adopt a configuration in which the entire region 36 of the signal contact 12 is completely covered with a material of high dielectric constant (or the rib 70). Also, in place of the connector configuration shown in which the signal contact pair 14 and the ground contact 16 are aligned in parallel, one can apply the configuration of the present invention to a connector of multi-row structure having plural rows of signal contact pairs 14 and the ground contact 16.

While the invention has been described with reference to specific preferred embodiments, it will be understood by those skilled in the art that various changes and modifications may be made thereto without departing from the scope of the following claims.

The invention claimed is:

1. A high speed transmission connector comprising:

a plurality of signal contact pairs, said signal contact pairs being arranged in a parallel array, and each of said signal contact pairs including a pair of signal contacts comprising a balanced transmission line;

a plurality of ground contacts, each of said ground contacts being arranged between two of said signal contact pairs arranged in said parallel array, said plurality of signal contact pairs and said plurality of ground contacts being alternately arranged relative to each other; and an electro-insulating body supporting said plurality of signal contact pairs and said plurality of ground contacts in a mutually insulated arrangement;

wherein each of said signal contacts of said plurality of signal contact pairs is provided with a contacting section at one longitudinal end for a conductive contact with a corresponding signal contact of a counterpart connector, a board connecting section at another longitudinal end for a connection with a conductor on a circuit board, and an attaching section between said contacting section and said board connecting section for an attachment to said body;

wherein all of board connecting sections of said signal contacts of said plurality of signal contact pairs are disposed in parallel along a first lateral surface of said body and extend to positions at an equal distance from said first lateral surface;

wherein said pair of signal contacts of said plurality of signal contact pairs are individually covered, at least partially, by materials having dielectric constants different from each other, in certain regions, each region being defined between said board connecting section and said attaching section of each signal contact;

wherein the signal contacts of each signal contact pair are supported with the respective contacting sections and attaching sections opposed and aligned in a transverse direction of said body so as to form a mirror image of each other; and wherein said regions between said board connecting sections and said attaching sections, as well as said board connecting sections, of the signal contacts of each signal contact pair are offset in a direction perpendicular to the transverse direction;

wherein each of said plurality of ground contacts is provided with a pair of contacting sections at one longitudinal end for a conductive contact with a corresponding ground contact of a counterpart connector, a pair of board connecting sections at another longitudinal end for a connection with a grounding potential on a circuit board, and an attaching section between said contacting sections and said board connecting sections for an attachment to said body; and wherein all of board connecting sections of said ground contacts are disposed respectively along said first lateral surface and a second lateral surface of said body, opposite to said first lateral surface.

2. A high speed transmission connector as set forth in claim 1, wherein a material covering at least one of said regions of said pair of signal contacts is a part of said body.

3. A high speed transmission connector as set forth in claim 1, wherein a material covering one of said regions of said pair of signal contacts is air.

4. A high speed transmission connector as set forth in claim 1, wherein said region of one of said pair of signal contacts, covered by a first material having a higher dielectric constant, is smaller in cross-sectional area than a region of another signal contact covered by a second material having a lower dielectric constant.

5. A high speed transmission connector as set forth in claim 1, wherein each of said plurality of ground contacts is shaped in such a manner as to conceal said pair of signal contacts of each of said plurality of signal contact pairs as seen in a direction of said parallel array, when said plurality of signal contact pairs and said plurality of ground contacts are disposed at proper positions on said body.

* * * * *